US010232619B2

(12) United States Patent
Chen et al.

(10) Patent No.: US 10,232,619 B2
(45) **Date of Patent: *Mar. 19, 2019**

(54) PRINTHEAD WITH BOND PAD SURROUNDED BY DAM

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US); Devin A. Mourey, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/883,316

(22) Filed: Jan. 30, 2018

(65) Prior Publication Data

US 2018/0154632 A1 Jun. 7, 2018

Related U.S. Application Data

(63) Continuation of application No. 15/039,809, filed as application No. PCT/US2013/072261 on Nov. 27, 2013, now Pat. No. 9,919,524.

(51) Int. Cl.

| | |
|---|---|
| ***B41J 2/14*** | (2006.01) |
| ***B41J 2/045*** | (2006.01) |
| ***B41J 2/16*** | (2006.01) |

(52) U.S. Cl.

CPC ..... *B41J 2/1433* (2013.01); *B41J 2/0458* (2013.01); *B41J 2/04541* (2013.01); (Continued)

(58) Field of Classification Search

CPC ..... B41J 2/1433; B41J 2/1637; B41J 2/1632; B41J 2/04541; B41J 2/1603; B41J 2/14072; B41J 2/0458; B41J 2/1623

See application file for complete search history.

(56) References Cited

U.S. PATENT DOCUMENTS

| | | | |
|---|---|---|---|
| 6,155,676 | A | 12/2000 | Etheridge et al. |
| 6,557,976 | B2 | 5/2003 | Mcelfresh et al. |

(Continued)

FOREIGN PATENT DOCUMENTS

| | | |
|---|---|---|
| CN | 1817652 | 8/2006 |
| CN | 105555539 | 5/2016 |

(Continued)

OTHER PUBLICATIONS

Lau et al; "Thermal Stress Analysis of Tape Automated Bonding Packages and Interconnections"; Mar. 1990; vol. 13, No. I, pp. 182-187; http://ieeexplore.ieee.org/xpl/login.jsp?tp=&arnumber=528688&url=http%3A%2F%2Fieeexplore.ieee.org%2Fxpls%2Fabs_all.jsp%3Farnumber%3D52868.

*Primary Examiner* — Geoffrey S Mruk
(74) *Attorney, Agent, or Firm* — HP Inc. Patent Department

(57) ABSTRACT

In an embodiment, a printhead includes a fluidic die molded into a moldable material. The die has a front surface exposed outside the moldable material to dispense fluid and an opposing back surface covered by the moldable material except at a channel in the moldable material through which fluid may pass directly to the back surface. The die has a first bond pad on the front surface surrounded by a first dam to prevent the moldable material from contacting the first bond pad.

20 Claims, 7 Drawing Sheets

(52) U.S. Cl.
CPC ..... *B41J 2/14072* (2013.01); *B41J 2/1603* (2013.01); *B41J 2/1623* (2013.01); *B41J 2/1632* (2013.01); *B41J 2/1637* (2013.01)

(56) References Cited

U.S. PATENT DOCUMENTS

| | | | | |
|---|---|---|---|---|
| 6,641,254 | B1 | 11/2003 | Boucher | |
| 7,084,499 | B2 | 8/2006 | Shen | |
| 7,862,147 | B2 | 1/2011 | Ciminelli | |
| 8,357,987 | B2 | 1/2013 | Lin | |
| 8,507,321 | B2 | 8/2013 | Lin et al. | |
| 9,919,524 | B2 * | 3/2018 | Chen | B41J 2/04541 |
| 2003/0001936 | A1 * | 1/2003 | Hirosawa | B41J 2/055<br>347/87 |
| 2003/0193545 | A1 | 10/2003 | Boucher | |
| 2005/0099456 | A1 | 5/2005 | Higa et al. | |
| 2009/0079793 | A1 | 3/2009 | Chung-Long-Shan | |
| 2016/0221341 | A1 | 8/2016 | Chen et al. | |

FOREIGN PATENT DOCUMENTS

| | | |
|---|---|---|
| JP | 63308924 | 12/1988 |
| JP | 05251856 | 9/1993 |
| WO | WO-2012023941 | 2/2012 |

* cited by examiner

PRINTHEAD WITH BOND PAD SURROUNDED BY DAM

RELATED DOCUMENTS

The present application is a continuation of, and claims the benefit of U.S. application Ser. No. 15/039,809, filed May 26, 2016, which is now U.S. Pat. No. 9,919,524 and which claims benefit under 35 U.S.C. § 371 and is the National Stage Entry of International Application No. PCT/US2013/072261, filed Nov. 27, 2013. These applications are herein incorporated by reference in their entireties.

BACKGROUND

Wire bonding is an interconnect technology used in the fabrication of various semiconductor, microelectronic, and MEMS (microelectromechanical systems) devices including, for example, inkjet printheads. Typically, wire bonding is used for connecting an integrated circuit (IC) or other semiconductor device with its packaging, but it can also be used for other types of interconnections such as connecting one printed circuit board (PCB) with another, connecting an IC die with a PCB, connecting an IC to other electronic components, and so on. In wire bonding, a small wire made of metal such as gold, copper, or aluminum, is attached at both ends through a weld made using heat, pressure, ultrasonic energy, or some combination thereof. In some cases, one or both ends of a wire can be attached to bond pads on a PCB or IC die. In general, bond pads provide metallic surface areas on the PCB or die that enable various interconnections including wire bonding, soldering, flip-chip mounting, and probe needles. However, if access to a bond pad is blocked or impeded by debris or other physical obstruction, a wire bond or other interconnection to the bond pad may not be possible.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
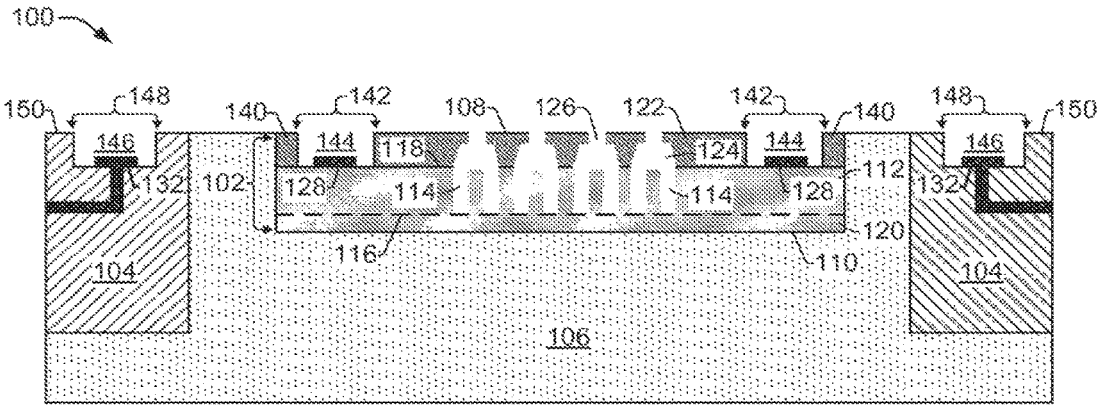
FIG. 1 is an elevation section view showing a portion of an example molded printhead that is suitable for use in a print cartridge and/or print bar of an inkjet printer.

Current inkjet printheads incorporate integrated circuitry (e.g., thermal heating and drive circuitry) with fluidic structures including fluid ejection chambers and nozzles onto the same silicon die substrate. A fluid distribution manifold (e.g., a plastic interposer or chiclet) and slots formed in the die substrate, together, provide fluidic fan-out from the microscopic ejection chambers to larger ink supply channels. However, the die slots occupy valuable silicon real estate and add significant slot processing costs. A smaller, less costly silicon die can be achieved by using a tighter slot pitch, but the costs associated with integrating the smaller die with a fan-out manifold and inkjet pen more than offset the benefit of the less costly die.

Ongoing efforts to reduce inkjet printhead costs have given rise to new, molded inkjet printheads that break the connection between the size of the die needed for the ejection chambers and the spacing needed for fluidic fan-out. The molded inkjet printheads enable the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. Methods of forming the molded inkjet printheads include, for example, compression molding and transfer molding methods such as those described, respectively, in international patent application numbers PCT/US2013/052512, filed Jul. 29, 2013 titled Fluid Structure with Compression Molded Fluid Channel, and PCT/US2013/052505, filed Jul. 29, 2013 titled Transfer Molded Fluid Flow Structure, each of which is incorporated herein by reference in its entirety.

Like conventional inkjet printheads, the molded inkjet printheads can use wire bonds to bring electrical signals to and from a printhead die substrate. As generally noted above, wire bonding is a common interconnect method used in the fabrication of many semiconductor and microelectronic devices that involves welding the ends of small wires to bonding pads on integrated circuit (IC) dies or printed circuit boards (PCB). After wire bond interconnects are made, they are usually encapsulated for protection. However, before making a wire bond interconnection, it is important that the bond pad remains accessible and free from any obstruction that might prevent the wire from contacting and bonding to the bond pad. Unfortunately, molding methods employed to form the molded inkjet printheads noted above can result in excess molding compound or other molding material, called "flash", that obstructs or seals off the bond pad regions on the printhead dies and adjacent PCB. These obstructions can prevent the formation of wire bond interconnects between bond pads on the dies and PCB. Resolving this problem can involve using a laser or other costly means to open vias in the molding compound to provide access to the bond pads and enable wire bonds or other electrical interconnects.

Example implementations of molded inkjet printheads with embedded PCBs and sliver dies described herein provide recessed bond pads that enable low cost wire bond interconnections. A bond pad on a sliver die or PCB is recessed into the front surface material of the die or PCB so that a dam surrounds the bond pad region and prevents epoxy mold compound or other molding material from entering the bond pad region during the molding process. For example, a sliver die with recesses in the SU8 firing chamber layer that surrounds die bond pad regions, and an FR4 PCB with recesses in the FR4 glass epoxy that surrounds PCB bond pad regions, are placed onto a carrier with their front surfaces facing the carrier thermal release tape. The dams on the die and FR4 board keep the EMC (epoxy mold compound) flash out of the bond pad regions and off of the bond pads during the molding process. When the die and PCB are released from the carrier, the bond pads are open (i.e., not obstructed by EMC) which enables wire bonding the die to the PCB for electrical interconnects.

In one example, a printhead includes a printhead die molded into a molding. The die has a front surface exposed outside the molding to dispense fluid, such as dispensing ink through nozzles on the front surface of the die. The die has an opposing back surface that is covered by the molding, except where a channel has been formed in the molding through which fluid can pass directly to the back surface. A bond pad on the front surface of the die is surrounded by a dam that prevents the molding from contacting the bond pad.

In another example, a print cartridge includes a housing to contain a printing fluid, and a printhead. The printhead includes a die sliver embedded in a molding with a back surface covered by the molding and a front surface left exposed, and the molding is mounted to the housing. The molding has a channel therein through which fluid may pass to the back surface of the die sliver. The die sliver has a bond pad surrounded by a dam to keep the molding off the bond pad.

In another example, a print bar includes multiple printhead dies and a PCB embedded in a molding. Die bond pads are recessed beneath front surfaces of the dies, and PCB bond pads are recessed beneath a front surface of the PCB. Bond wires connect the die bond pads with the PCB bond pads.

As used in this document, a "printhead" and a "printhead die" mean the part of an inkjet printer or other inkjet type dispenser that can dispense fluid from one or more openings. A printhead includes one or more printhead dies. A die "sliver" means a printhead die with a ratio of length to width of 50 or more. A printhead and printhead die are not limited to dispensing ink and other printing fluids, but instead may also dispense other fluids for uses other than printing.

Illustrative Embodiments

FIG. 1 is an elevation section view showing a portion of an example molded printhead 100 that is suitable for use in a print cartridge and/or print bar of an inkjet printer. The printhead 100 incorporates dams surrounding bond pad regions that prevent excess flash molding material from entering the bond pad regions during a molding process. Bond pads recessed beneath the dams remain clear of molding material which enables subsequent wire bond and encapsulation processes.

The printhead 100 includes an elongated thin "sliver" printhead die 102 and a PCB 104 (printed circuit board) molded into a monolithic body 106, or molding 106, formed of plastic or other moldable material. The printhead die 102 is molded into the molding 106 such that a front surface 108 of the die 102 is exposed outside of the molding 106, enabling the die to dispense fluid. The die 102 has an opposing back surface 110 that is covered by the molding 106, except at a channel 138 formed in the molding through which fluid may pass directly to the die 102 (e.g., see FIG. 2). In different implementations, such as those described below with respect to FIGS. 5-9, for example, a printhead 100 may include one or multiple printhead dies 102 embedded within the monolithic molding 106 in different configurations, with each die 102 having a corresponding fluid channel 138 (FIG. 2) formed in the molding 106 to carry printing fluid directly to the back surface 110 of the die 102.

Each printhead die 102 includes a silicon die substrate 112 comprising a thin silicon sliver on the order of 100 microns in thickness. The silicon substrate 112 includes fluid feed holes 114 dry etched or otherwise formed therein to enable fluid flow through the substrate 112 from a first substrate surface 116 to a second substrate surface 118. The silicon substrate 112 further includes a thin silicon cap 120 (i.e., a cap over the silicon substrate 112) adjacent to and covering the first substrate surface 116. The silicon cap 120 is on the order of 30 microns in thickness and can be formed of silicon or some other suitable material.

Formed on the second substrate surface 118 are one or more layers 122 that define a fluidic architecture that facilitates the ejection of fluid drops from the printhead structure 100. The fluidic architecture defined by layer(s) 122 generally includes ejection chambers 124 having corresponding orifices 126, a manifold (not shown), and other fluidic channels and structures. The layer(s) 122 can include, for example, a chamber layer formed on the substrate 112 and a separately formed orifice layer over the chamber layer, or, they can include a single monolithic layer that combines the chamber and orifice layers. The fluidic architecture layer 122 is typically formed of an SU8 epoxy or some other polyimide material, and can be formed using various processes including a spin coating process and a lamination process.

In addition to the fluidic architecture defined by layer(s) 122 on silicon substrate 112, the printhead die 102 includes integrated circuitry formed on the substrate 112 using thin film layers and elements not shown in FIG. 1. For example, corresponding with each ejection chamber 124 is a thermal ejection element or a piezoelectric ejection element formed on substrate 112. The ejection elements are actuated to eject drops or streams of ink or other printing fluid from chambers 124 through orifices 126. Ejection elements on printhead die 102 are connected to bond pads 128 or other suitable electrical terminals on printhead die 102 directly or through substrate 112.

Figure 2:
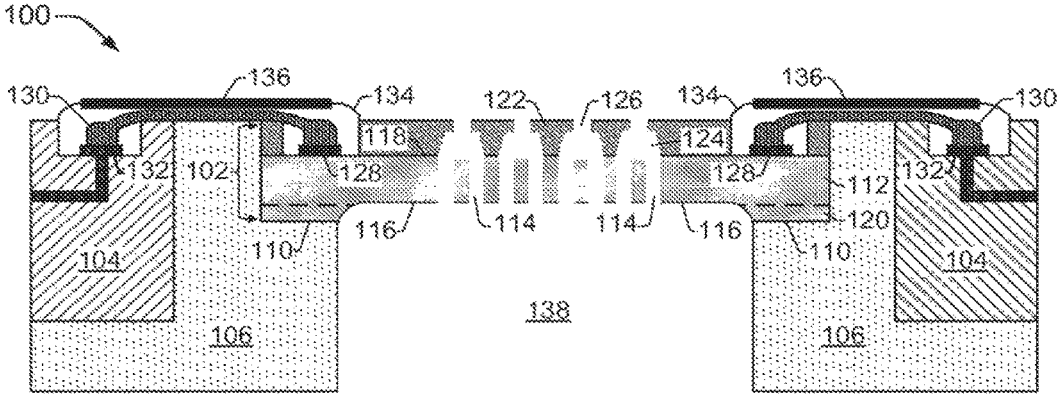
FIG. 2 shows the example molded printhead of FIG. 1, with wire bonds connecting die bond pads with printed circuit board (PCB) bond pads on an adjacent PCB.

As shown in FIG. 2, wire bonds 130 connect the die bond pads 128 with printed circuit board (PCB) bond pads 132 on an adjacent PCB 104. The PCB bond pads 132 are connected to signal traces in a flex circuit 522 (FIGS. 6, 7), and ultimately to a controller (FIG. 5, 514; FIG. 8, 812) on an inkjet printing device (FIG. 5, 500; FIG. 8, 800), as described in international patent application number PCT/US2013/068529, filed Nov. 5, 2013 titled Molded Printhead, which is incorporated herein by reference in its entirety. Bond wires 130 are covered by an epoxy or other suitable protective material 134. A flat cap 136 may be added over the protective material 134 to form a more flat, lower profile protective covering on bond wires 130.

Also shown in FIG. 2 is a fluid channel 138. The fluid channel 138 is formed through molded body 106 and the thin silicon cap 120, and it connects with the printhead die substrate 112 at the first substrate surface 116. The fluid channel 138 provides a fluid pathway through the molded body 106 and thin silicon cap 120 that enables fluid to flow directly onto the silicon substrate 112 at the first substrate surface 116, and into the silicon substrate 112 through the fluid feed holes 114. The fluid channel 138 can be formed in the molded body 106 in a number of ways. For example, a rotary or other type of cutting saw can be used to cut and define the channel 138 through the molded body 106 and thin silicon cap 120. Using saw blades with differently shaped peripheral cutting edges and in varying combinations, channels 138 can be formed having varying shapes that facilitate the flow of fluid to the first substrate surface 116. In other examples, most of the channel 138 can be formed as the printhead die 102 is being molded into the molded body 106 of the printhead 100 during a compression or transfer molding process. A material ablation process (e.g., powder blasting, etching, lasering, milling, drilling, electrical discharge machining) can then be used to remove residual molding material and the material from the silicon cap 120. The ablation process extends the channel 138 and completes the fluid pathway through the molded body 106 and thin silicon cap 120. When a channel 138 is formed using a molding process, the shape of the channel 138 generally reflects the inverse shape of the mold chase topography being used in the process. Accordingly, varying the mold chase topographies can yield a variety of differently shaped channels that facilitate the flow of fluid to the first surface 116 of silicon substrate 112.

Referring again to FIG. 1, the fluidic architecture layer 122 includes an edge segment 140 on the silicon die substrate 112. The edge segment 140 is part of the fluidic architecture layer 122 formed on the second substrate surface 118. Thus, the edge segment 140 is formed at the same time, by the same processing, and of the same material (e.g., SU8) as the rest of the fluidic architecture layer 122. The edge segment 140 runs along the perimeter of the substrate 112, forming an SU8 dam 142 or barrier around the die bond pad regions 144. More specifically, the edge segment 140 of the fluidic architecture layer 122 extends to the outer edge or perimeter of the substrate 112 and around the die bonds 128, which forms an SU8 dam 142 around the die bond pad regions 144. The die bond pads 128 are therefore recessed into or beneath the front surface 108 of the die 102.

During the molding process when the printhead die 102 is embedded into the monolithic molding 106, the SU8 dam 142 prevents excess epoxy mold compound or other molding material (i.e., "flash") from entering the die bond pad regions 144 and obstructing access to the die bond pads 128. This enables subsequent wire bond connections to be made without having to use additional process steps (e.g., lasering) to remove the flash molding in order to provide access to the die bond pads 128.

The PCB bond pads 132 and bond pad regions 146 on the adjacent PCB 104 are also protected during the molding process from flash molding by a dam 148 or barrier. The PCB 104 can be, for example, a rigid PCB comprising an FR4 glass-epoxy panel with a thin layer of copper foil laminated to one, or both sides. In other examples, the PCB 104 can be a flexible PCB comprising flexible material such as kapton or other polyimide film. An FR4 PCB can have circuitry etched into the copper layers and can include single or multiple layers. With an FR4 PCB, there are various ways to form the PCB dam 148 around the PCB bond pads 132 including, for example, a pre-impregnated (pre-preg) epoxy material layer, a carbon layer material such as kapton, a solder mask material, and so on. A PCB dam 148 can be formed in these materials, for example, by routing or punching out a hole, or by using photolithography to pattern a hole. Similar to the die bond pads 128 on die 102, the PCB bond pads 132 on PCB 104 are recessed into or beneath the front surface 150 of the PCB 104. During the molding process when the PCB 104 is embedded into the monolithic molding 106, the PCB dam 148 prevents excess molding flash from entering the PCB bond pad regions 146 and obstructing access to the PCB bond pads 132. Wire bond connections can then be made to the PCB bond pads 132 without having to use additional process steps (e.g., lasering) to remove molding flash.

Figure 3:
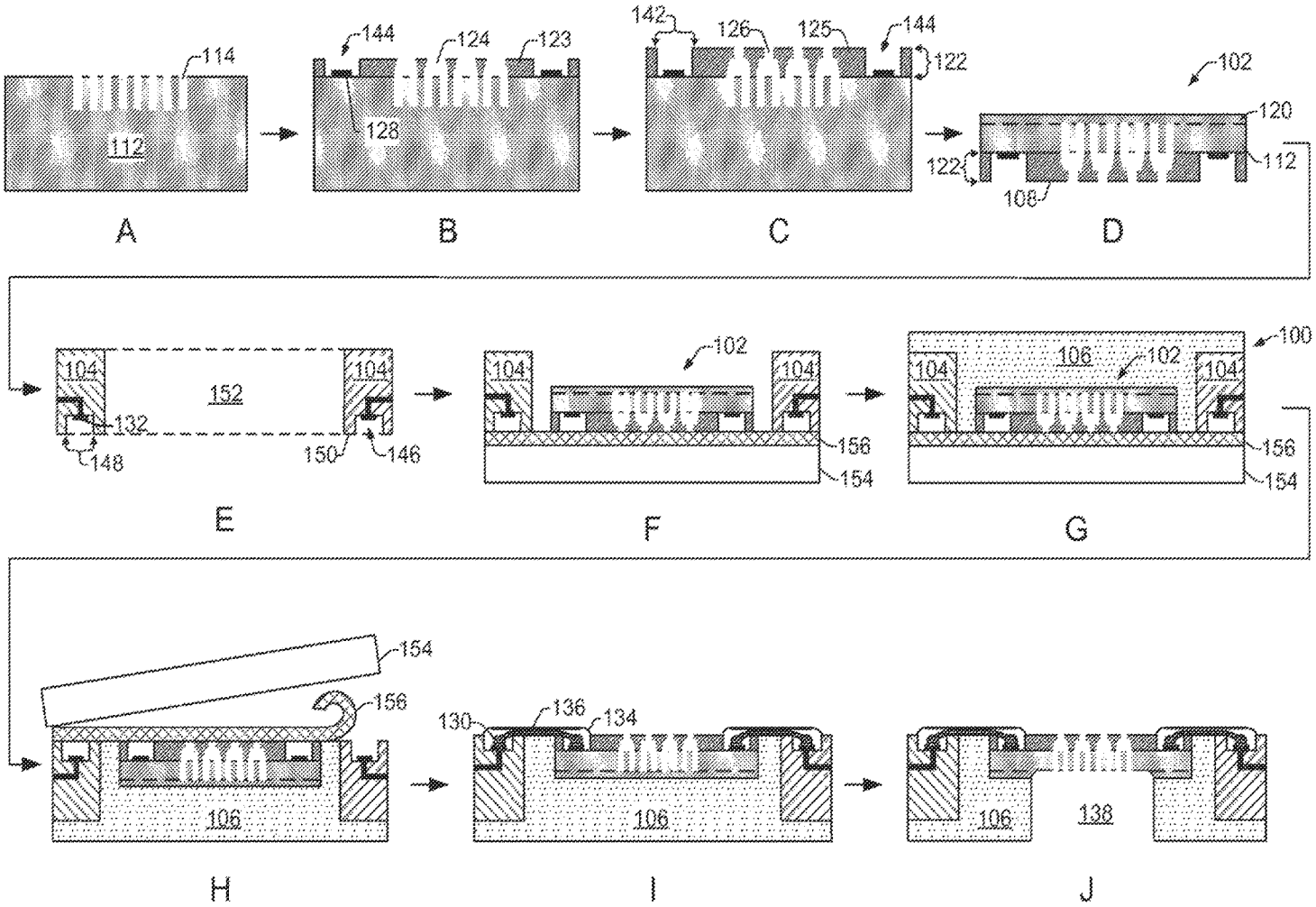
FIG. 3 shows an example process for making a printhead having dams that surround bond pad regions to prevent excess flash molding material from entering the bond pad regions during a molding process.
Figure 4:
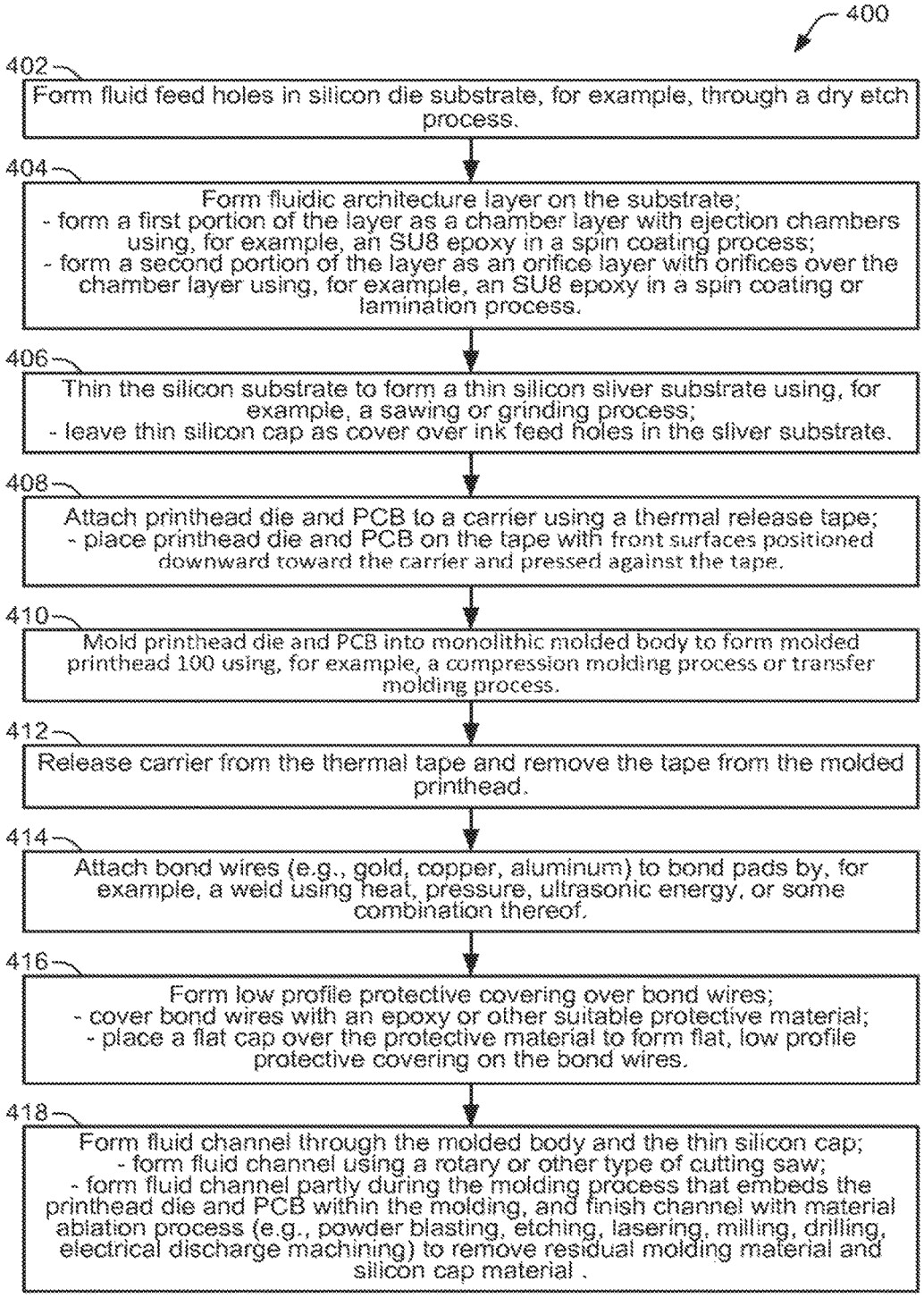
FIG. 4 is a flow diagram of the example process shown in FIG. 3.

FIG. 3 illustrates an example process for making a printhead 100 having dams (142, 148) that surround bond pad regions (144, 146) and prevent excess flash molding material from entering the bond pad regions during a molding process. FIG. 4 is a flow diagram 400 of the process illustrated in FIG. 3. As shown in FIG. 3 at part "A", a silicon die substrate 112 includes fluid feed holes 114. Fluid feed holes 114 have been previously formed, for example, through a dry etching process (step 402 in FIG. 4). The silicon substrate 112 is subsequently thinned to a thin silicon sliver on the order of 100 microns in thickness.

As shown at parts "B" and "C" in FIG. 3, a fluidic architecture layer 122 is formed on the substrate 112 (step 404 in FIG. 4). The layer 122 is formed around previously processed die bond pads 128, and forms a dam 142 around the bond pad regions. In part "B", a first portion of layer 122 comprises a chamber layer 123 formed, for example, of an SU8 epoxy in a spin coating process. The chamber layer 123 includes ejection chambers 124. In part "C", a second portion of layer 122 comprises an orifice layer 125 formed over the chamber layer 123. The orifice layer 125 is typically formed of an SU8 epoxy in a spin coating or lamination process. The orifice layer 125 includes orifices 126 corresponding with ejection chambers 124. As noted above, in some implementations layer 122 can include a single monolithic layer that combines the chamber and orifice layers.

As shown at part "D" of FIG. 3, the silicon substrate 112 is thinned to form a thin silicon sliver substrate 112 on the order of 100 microns in thickness (step 406 in FIG. 4). The substrate 112 can be thinned, for example, using a sawing or grinding process. When the substrate 112 is thinned, a thin silicon cap 120 (on the order of 30 microns in thickness) can be left as a covering over the ink feed holes 114 in the sliver substrate 112. The sliver substrate 112 with layer 122, together, comprise a sliver printhead die 102. Also shown in part "D", the printhead die 102 is flipped over in preparation for subsequent processing steps. In part "E", a PCB 104 is shown in a pre-processed state that includes PCB bond pads 132 that are recessed into or beneath the front surface 150 of the PCB 104 and with PCB dams 148 surrounding the PCB bond pad regions 146. One or more windows 152 have also been cut out of the PCB 104 as locations into which one or more printhead dies 102 will be positioned prior to a molding process in which the PCB 104 and printhead die(s) 102 are embedded in a monolithic molding 106 to form a printhead 100.

As shown at part "F" of FIG. 3, the printhead die 102 and PCB 104 are attached to a carrier 154 using a thermal release tape 156 (step 408 in FIG. 4). The printhead die 102 and PCB 104 are placed on the tape 156 with the front surfaces 108 and 150, respectively, positioned downward toward the carrier 154 and pressed against the tape 156. The contact between the front surfaces 108 and 150 with the tape 156 seals the dams 142 and 148, and prevents epoxy mold compound material from entering into bond pad regions 144 and 146 of the printhead die 102 and PCB 104 during a subsequent molding process (step 410 in FIG. 4). The molding process can be, for example, a compression molding process or transfer molding process that yield a molded printhead 100 as shown in part "G" that includes a printhead die 102 and PCB 104 embedded within a monolithic molded body 106. Also as shown in part "G", the bond pad regions 144 and 146 (and bond pads 128 and 132) of the printhead die 102 and PCB 104, respectively, have been kept free of molding material that was used to form the molded body 106 during the molding process.

As shown at part "H" of FIG. 3, the carrier 154 is released from the thermal tape 156 and the tape is removed from the molded printhead 100 (step 412 in FIG. 4). As shown at part "I" of FIG. 3, bond wires 130 are attached to bond pads 128 and 132 to bring electrical signals to and from the printhead die 102 through PCB 104 (step 414 in FIG. 4). The bond wires 130 comprise small metal wires made of a metal such as gold, copper, or aluminum, and they can be attached to bond pads by a weld made using heat, pressure, ultrasonic energy, or some combination thereof. The bond wires 130 are covered by an epoxy or other suitable protective material 134, and a flat cap 136 is placed over the protective material 134 to form a more flat, lower profile protective covering on the bond wires 130 (step 416 in FIG. 4).

As shown at part "J" of FIG. 3, a fluid channel 138 is formed through the molded body 106 and the thin silicon cap 120 (step 418 in FIG. 4). As noted above, the fluid channel 138 can be formed using a rotary or other type of cutting saw. The channel 138 can also be partly formed during the molding process that embeds the printhead die 102 and PCB 104 within the molding 106. A material ablation process (e.g., powder blasting, etching, lasering, milling, drilling, electrical discharge machining) can then be used to remove residual molding material and the material from the silicon cap 120 to complete the channel 138.

Figure 5:
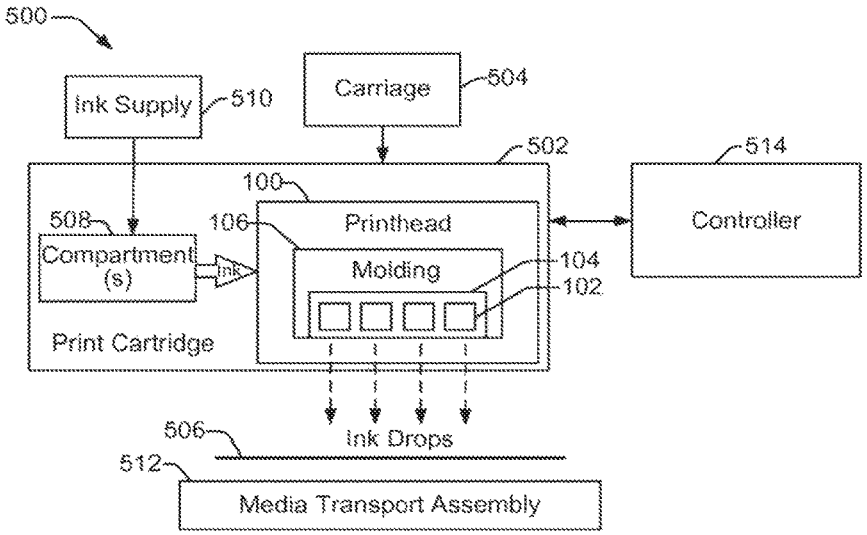
FIG. 5 is a block diagram showing an example inkjet printer with a print cartridge that incorporates an example of a molded printhead.

As noted above, the molded printhead 100 is suitable for use in, for example, a print cartridge and/or print bar of an inkjet printer. FIG. 5 is a block diagram showing an example of an inkjet printer 500 with a print cartridge 502 that incorporates one example of a molded printhead 100. In printer 500, a carriage 504 scans print cartridge 502 back and forth over a print media 506 to apply ink to media 506 in a desired pattern. Print cartridge 502 includes one or more fluid compartments 508 housed together with printhead 100 that receive ink from an external supply 510 and provide ink to printhead 100. In other examples, the ink supply 510 may be integrated into compartment(s) 508 as part of a self-contained print cartridge 502. During printing, a media transport assembly 512 moves print media 506 relative to print cartridge 502 to facilitate the application of ink to media 506 in a desired pattern. Controller 514 generally includes the programming, processor(s), memory(ies), electronic circuits and other components needed to control the operative elements of printer 500.

Figure 6:
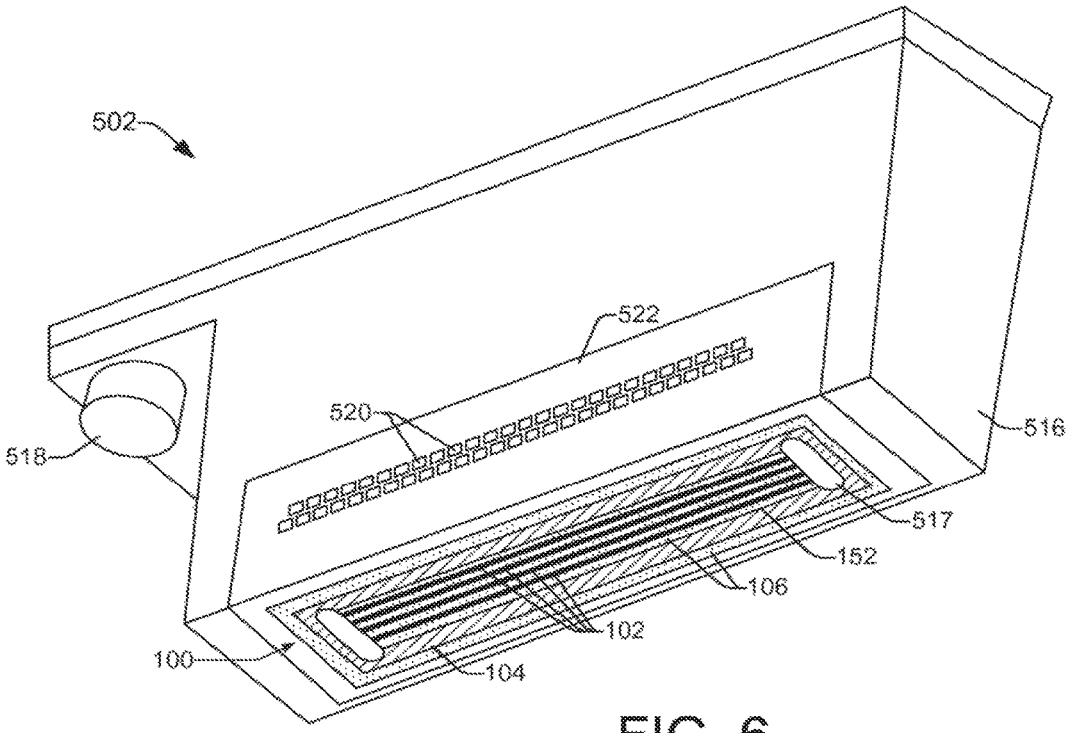
FIG. 6 shows a perspective view of an example print cartridge that incorporates an example of a molded printhead.

FIG. 6 shows a perspective view of an example print cartridge 502. Referring to FIGS. 5 and 6, print cartridge 502 includes a molded printhead 100 supported by a cartridge housing 516. Printhead 100 includes four elongated printhead dies 102 and a PCB 104 embedded in a molding 106. In the example shown, the printhead dies 102 are arranged parallel to one another across the width of printhead 100. The four printhead dies 102 are located within a window 152 that has been cut out of PCB 104. While a single printhead 100 with four dies 102 is shown for print cartridge 502, other configurations are possible, for example with more printheads 100 each with more or fewer dies 102. At either end of the printhead dies 102 are bond wires 130 (not shown) covered by low profile protective coverings 517 comprising a suitable protective material such as an epoxy, and a flat cap placed over the protective material.

Print cartridge 502 is fluidically connected to ink supply 510 through an ink port 518, and is electrically connected to controller 514 through electrical contacts 520. Contacts 520 are formed in a flex circuit 522 affixed to the housing 516. Signal traces (not shown) embedded in flex circuit 522 connect contacts 520 to corresponding contacts (not shown) on printhead 100. Ink ejection orifices 126 (not shown in FIGS. 5 and 6) on each printhead die 102 are exposed through an opening in flex circuit 522 along the bottom of cartridge housing 516.

Figure 7:
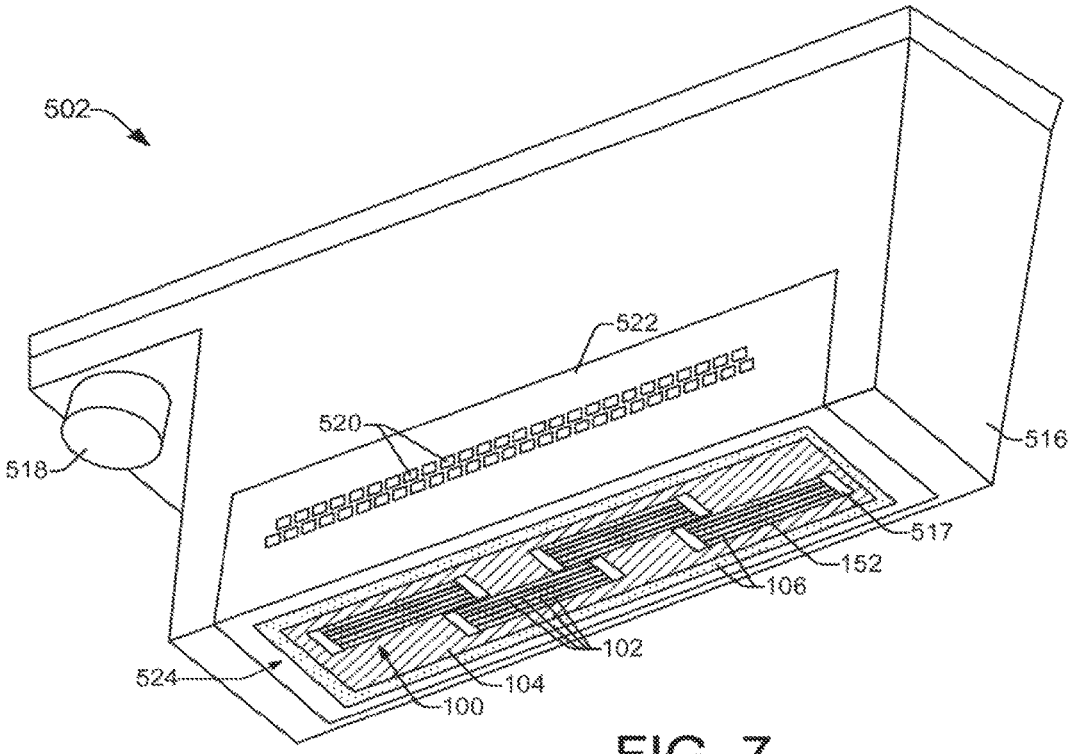
FIG. 7 shows a perspective view of another example print cartridge that incorporates an example of a molded printhead.
Figure 8:
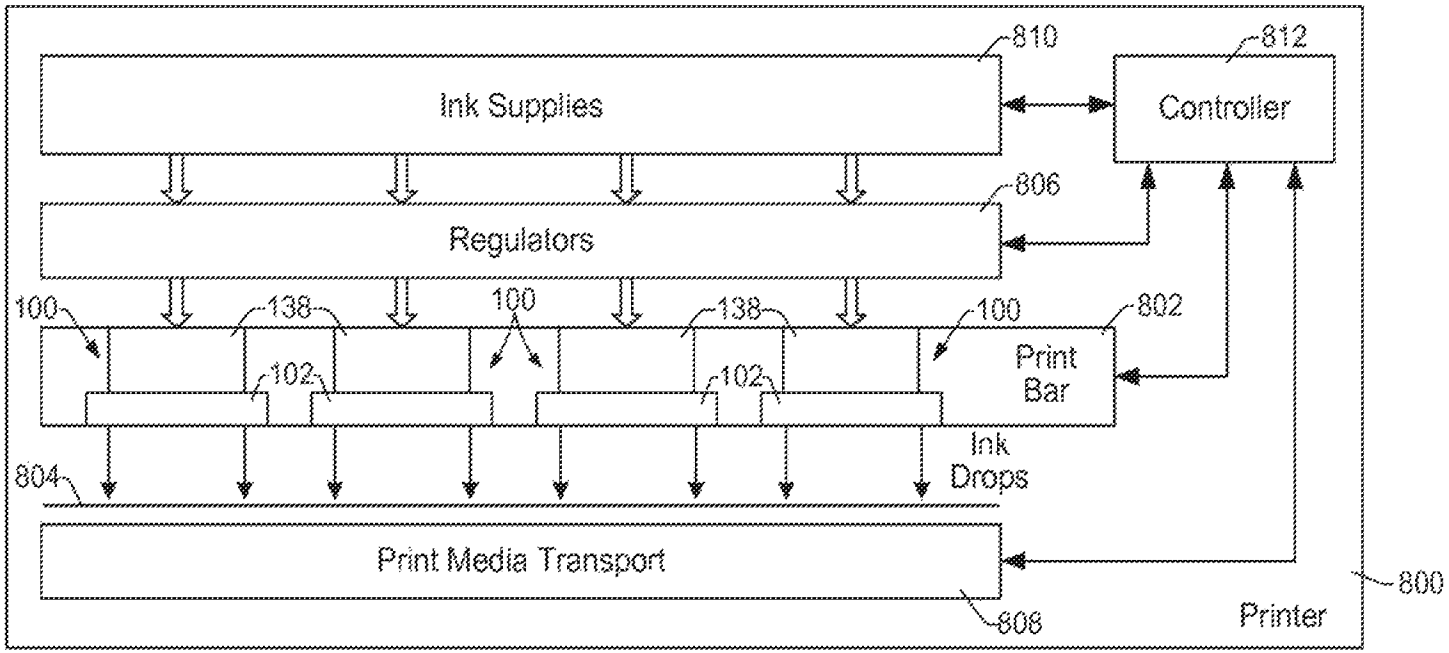
FIG. 8 is a block diagram showing an inkjet printer with a media wide print bar implementing an example of a molded printhead.

FIG. 7 shows a perspective view of another example print cartridge 502 suitable for use in a printer 500. In this example, the print cartridge 502 includes a printhead assembly 524 with four printheads 100 and a PCB 104 embedded in a molding 106 and supported by cartridge housing 516. Each printhead 100 includes four printhead dies 102 and is located within a window 152 cut out of the PCB 104. While a printhead assembly 524 with four printheads 100 is shown for this example print cartridge 502, other configurations are possible, for example with more or fewer printheads 100 that each have more or fewer dies 102. At either end of the printhead dies 102 in each printhead 100 are bond wires 130 (not shown) covered by low profile protective coverings 517 comprising a suitable protective material such as an epoxy, and a flat cap placed over the protective material. As in the example cartridge 502 shown in FIG. 6, an ink port 518 fluidically connects cartridge 502 with ink supply 510 and electrical contacts 520 electrically connect printhead assembly 524 of cartridge 502 to controller 514 through signal traces embedded in flex circuit 522. Ink ejection orifices 126 (not shown in FIG. 7) on each printhead die 102 are exposed through an opening in flex circuit 522 along the bottom of cartridge housing 516.

FIG. 8 is a block diagram illustrating an inkjet printer 800 with a media wide print bar 802 implementing another example of a molded printhead 100. Printer 800 includes print bar 802 spanning the width of a print media 304, flow regulators 806 associated with print bar 802, a media transport mechanism 808, ink or other printing fluid supplies 810, and a printer controller 812. Controller 812 represents the programming, processor(s) and associated memories, and the electronic circuitry and components needed to control the operative elements of a printer 800. Print bar 802 includes an arrangement of printhead dies 102 for dispensing printing fluid on to a sheet or continuous web of paper or other print media 804. Each printhead die 102 receives printing fluid through a flow path from supplies 810 into and through flow regulators 806 and fluid channels 138 in print bar 802.

Figure 9:
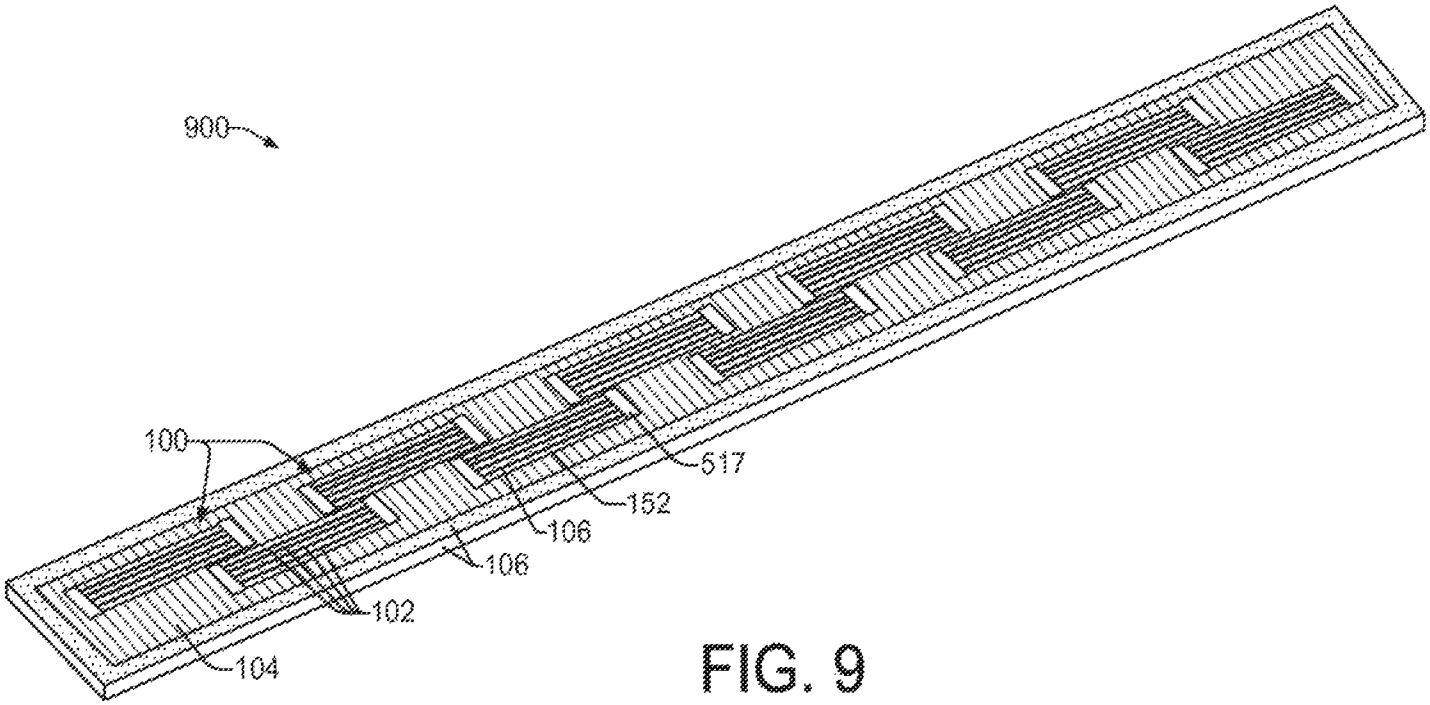
FIG. 9 is a perspective view showing a molded print bar with multiple printheads.

FIG. 9 is a perspective view showing a molded print bar 900 with multiple printheads 100 that is suitable for use in the printer 800 shown in FIG. 8. The molded print bar 900 includes multiple printheads 100 and a PCB 104 embedded in a molding 106. The printheads 100 are arranged within windows 152 cut out of PCB 104 that are in a row lengthwise across the print bar 900 in a staggered configuration in which each printhead overlaps an adjacent printhead. Although ten printheads 100 are shown in a staggered configuration, more or fewer printheads 100 may be used in the same or a different configuration. At either end of the printhead dies 102 in each printhead 100 are bond wires 130 (not shown) that are covered by low profile protective coverings 517 comprising a suitable protective material such as an epoxy, and a flat cap placed over the protective material.

What is claimed is:

1. A fluid ejection device, comprising:

a fluidic die molded into a moldable material, the fluidic die comprising a front surface exposed outside the moldable material to dispense fluid; and at least one bond pad on the front surface surrounded by a first dam to prevent the moldable material from contacting the first bond pad.

2. The fluid ejection device of claim 1, wherein the first dam prevents the moldable material from contacting the first bond pad during deposition of the moldable material onto the fluidic die.

3. The fluid ejection device of claim 1, wherein the moldable material covers a back surface of the fluidic die and comprises a fluid channel defined in the moldable material through which a fluid may pass to the back surface of the fluidic die.

4. The fluid ejection device of claim 3, wherein the fluidic die comprises:

a silicon sliver substrate; and a fluidics layer formed on the substrate as the front surface of the die, wherein the fluid channel is formed in at least a portion of the fluidics layer.

5. The fluid ejection device of claim 1, wherein the fluidic die comprises:

a silicon substrate; and a fluidics layer formed on the substrate as the front surface of the die, wherein the first dam comprises a recess in the fluidics layer.

6. The fluid ejection device of claim 5, wherein:

the fluidics layer comprises:

a chamber layer with a fluid chamber on the substrate; and an orifice layer over the chamber layer comprising an orifice through which fluid may be dispensed from the fluid chamber; and the substrate is coupled to the chamber layer, the substrate comprising:

a number of fluid feed holes defined therein; and a silicon cap coupled to the substrate, wherein the fluid channel is formed in the silicon cap to fluidically couple the fluid feed holes to the fluid chamber.

7. The fluid ejection device of claim 1, further comprising a printed circuit board (PCB) molded into the moldable material and comprising a second bond pad.

8. The fluid ejection device of claim 7, wherein the PCB comprises a second dam surrounding the second bond pad to prevent the moldable material from contacting the second bond pad.

9. The fluid ejection device of claim 8, further comprising:

a bond wire connecting the first and second bond pads; and a wire bond seal over the bond wire.

10. The fluid ejection device of claim 9, wherein the wire bond seal comprises:

an encapsulant covering the bond wire and bond pads; and a flat film over the encapsulant.

11. The fluid ejection device of claim 8, wherein the PCB comprises:

FR4 glass epoxy, a flexible polyimide film, a metal layer, or combinations thereof and the second dam comprises a recess in the FR4 glass epoxy, flexible polyimide film, metal layer, or combinations thereof.

12. A method of manufacturing the fluidic ejection device of claim 1:

defining the first dam in a front surface of the fluidic die, the first dam comprising the first bond pad disposed therein;

coupling the fluidic die to a printed circuit board (PCB);

defining at least one second dam on the PCB, the second dam comprising a second bond pad disposed therein;

overmolding the fluidic die with the moldable material, the first and second dams precluding the moldable material from contacting the first and second bond pads; and coupling the first bond pad to the second bond pad with a wire bond.

13. The method of claim 12, comprising covering the first bond pad, the second bond pad, and the wire bond with a protective material.

14. The method of claim 13, comprising covering the protective material with a cap.

15. The method of claim 12, comprising:

coupling the front surface of a fluidic die to a carrier, the coupling of the carrier to the front surface of a fluidic die sealing the first dam and the second dam;

overmolding the fluidic die with a moldable material; and decoupling the carrier from the front surface of a fluidic die.

16. The method of claim 12, comprising forming a fluid channel through the moldable material and a least a portion of the die, the fluid channel fluidically coupling the fluidic die to a fluid source.

17. A fluidic cartridge comprising:

a housing to contain a fluid; and a fluid ejection device fluidically coupled to the housing, the fluid ejection device comprising:

at least one die sliver molded into a moldable material, the die sliver comprising a front surface exposed outside the moldable material to dispense fluid;

and at least one bond pad on the front surface surrounded by a first dam to prevent the moldable material from contacting the first bond pad.

18. The fluidic cartridge of claim 17, wherein:

the at least one die sliver comprises multiple die slivers arranged parallel to one another laterally across the moldable material along a bottom part of the housing; and wherein the fluid ejection device comprises a fluid channel, the fluid channel comprising multiple elongated channels each positioned at the back surface of a corresponding one of the die slivers.

19. The fluidic cartridge of claim 17, wherein the fluidic cartridge comprises multiple die slivers arranged end to end along the moldable material in a staggered configuration wherein one or more of the die slivers overlaps an adjacent one or more of the die slivers.

20. The fluidic cartridge of claim 17, wherein the at least one die sliver comprises:

a silicon substrate; and a fluidics layer formed on the substrate as the front surface of the die, the first dam comprising a recess in the fluidics layer, wherein:

the fluidics layer comprises:

a chamber layer with a fluid chamber on the substrate; and an orifice layer over the chamber layer comprising an orifice through which fluid may be dispensed from the fluid chamber; and the substrate is coupled to the chamber layer, the substrate comprising:

a number of fluid feed holes defined therein; and a silicon cap coupled to the substrate, wherein the fluid channel is formed in the silicon cap to fluidically couple the fluid feed holes to the fluid chamber.

* * * * *